United States Patent [19]

Elliott

[11] 4,105,179

[45] Aug. 8, 1978

[54] LOCKABLE HOOK ASEMBLY FOR PERFORATED BOARD

[75] Inventor: Kenneth A. Elliott, Reno, Nev.

[73] Assignee: The Raymond Lee Organization, Inc., New York, N.Y.

[21] Appl. No.: 816,646

[22] Filed: Jul. 18, 1977

[51] Int. Cl.[2] ..... F16M 13/02

[52] U.S. Cl. ..... 248/221.2

[58] Field of Search ..... 248/220.3, 220.4, 221.1, 248/221.2; 211/792, 54, 59

[56] References Cited

U.S. PATENT DOCUMENTS

| | | | |
|---|---|---|---|
| 2,841,353 | 7/1958 | Burdick | 248/220.3 |
| 3,069,122 | 12/1962 | Babajoff | 248/221.2 |
| 3,241,799 | 3/1966 | Terlinde | 248/221.2 |
| 3,813,070 | 5/1974 | Hanson | 248/221.2 |
| 3,879,006 | 4/1975 | Staudte | 248/221.2 |

FOREIGN PATENT DOCUMENTS

| | | | |
|---|---|---|---|
| 1,472,212 | 1/1966 | France | 248/220.3 |

*Primary Examiner*—Robert A. Hafer

*Attorney, Agent, or Firm*—Howard I. Podell

[57] ABSTRACT

An assembly for locking a hook to a board to prevent the hook from disengaging from the board wherein the hook has an offset board engaging portion, a shank portion having a straight board engaging portion extending at right angle thereto with a notch near the shank. The hook is held in frictional contact with the board by a locking clip having an opening traversed by the offset board engaging portion of the hook and a curved indentation engaged in the notch of the straight board engaging portion of the hook.

4 Claims, 6 Drawing Figures

LOCKABLE HOOK ASEMBLY FOR PERFORATED BOARD

FIELD OF THE INVENTION

This invention relates to a hook and locking clip assembly for securing to a perforated board a hook to which are secured attachments.

The various hooks that are inserted through the holes of a perforated board easily become loose or fall to the annoyance of the user. These hooks usually consist of a double curved portion which is inserted in only one perforation of the board. Hence their inherent lack of stability.

THE PRIOR ART

The prior art, as exemplified in U.S. Pat. Nos. 3,392,949; 2,961,724; 3,272,468; 3,244,391 and 3,241,799 is generally illustrative of various devices of this type. While such devices are generally acceptable for their intended purpose, they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device a lockable hook assembly which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

BRIEF DESCRIPTION OF THE DRAWINGS:

In the accompanying drawing, in which is shown one of the various possible illustrative embodiments of this invention, wherein like reference character identify the same or like parts.

DESCRIPTION OF THE PREFERRED EMBODIMENT

Figure 1:
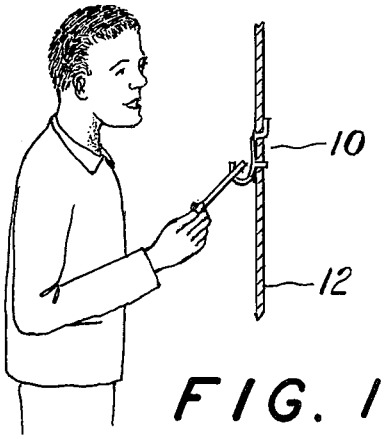
FIG. 1 is a side elevational view showing installation of the assembly to a board.
Figure 2:
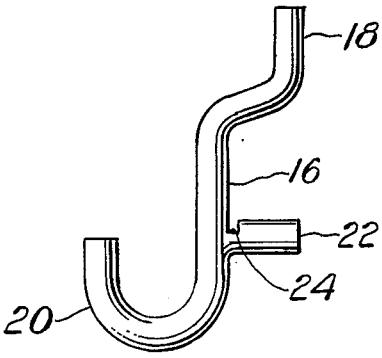
FIG. 2 is a side elevational view of the novel hook of the invention.

With reference to the drawing, there is shown and illustrated a lockable hook assembly constructed in accordance with the principles of the invention and designated generally by reference character 10.

The assembly of the present invention is intended for use with a conventional perforated board 12 which has a plurality of spaced perforations 14 formed therein.

The hook member of the assembly consists of a middle shank portion 16, an upper offset board engaging portion 18 which is doubly bent so that its upper extremity is parallel to the shank portion 16. The lower end of the shank terminates in an aricle suspending portion 20 bent away from the board engaging portion 18. Shank portion 16 has a second but straight board engaging portion 22 spaced from the straight part of portion 18 by the distance between two perforations in board 12 and also adapted to be inserted in a perforation.

Member 22 has a semi-spherical notch 24 in its upper side, one side of which is defined by the inside surface of shank 16.

The hook above described is made of tubular plastic or metal $\frac{1}{4}$ inch or $\frac{1}{8}$ inch in diameter.

Figure 3:
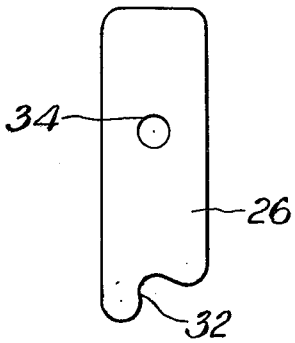
FIG. 3 is a top plan view of the clip or lock.
Figure 4:
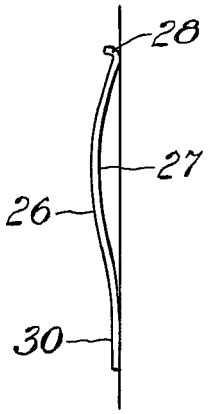
FIG. 4 is a side view of the clip of FIG. 3.
Figure 5:
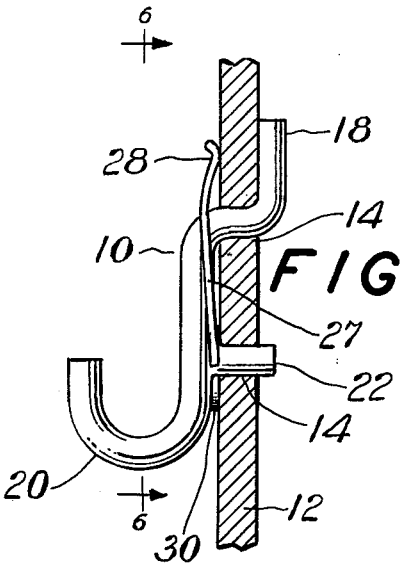
FIG. 5 is a side view of the hook and clip assembly on a perforated board.
Figure 6:
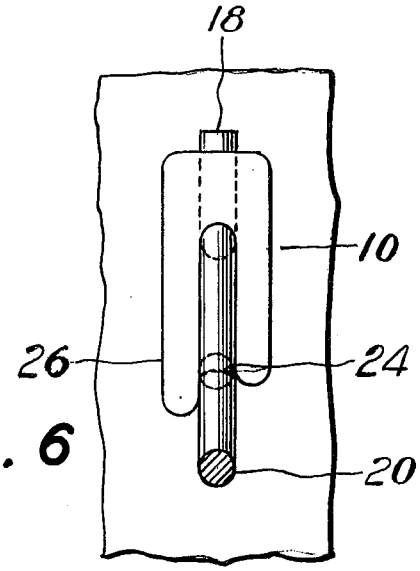
FIG. 6 is a front elevation of the assembly.

FIGS. 3 and 4 show the clip or lock plate 26 for locking the above hook in place.

As shown clip 26 consists of an elongated plate of metal or plastic preferably resilient in nature with an upper curved surface engaging portion 28, an arched central part 27. A lower straight surface engaging portion 30 which terminates in a curved indented section 32 adapted to engage the notch 24 of the hook in a locking relation. Clip 26 has in its curved portion 28 an opening 34 allowing passage therethrough of the upper part of the hook.

In use, the upper part of the hook is slipped through opening 34 of plate 26 and through the upper perforation of board 12. Then the straight board engaging member 22 is passed through the next perforation and the indentation 32 of plate 26 is laterally forced into engagement with notch 24. This engagement develops spring pressure between the upper parts 28 and 18 of the assembly and board 12 tending to keep the hook in place so that it will not inadvertently be dislodged.

Clip 26 is disengaged from notch 22 before the hook can be removed or moved from the board.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefor, a more lengthy description is deemed unnecessary.

It is to be understood that various changes in shape, size and arrangement of the elements of this invention as claimed may be resorted to in actual practice, if desired.

Having thus described the invention, what I claimed as new and to be secured by Letters Patent is:

1. A lockable assembly for a perforated board having a plurality of spaced perforations therethrough comprising a hook member having a first, offset, board engaging portion, a shank having a second, straight, board engaging portion extending therefrom; said second portion having a notch therein; said shank terminating in a bent article suspending portion; and a lock plate having an upper and a lower board surface engaging portions, an opening through which said offset portion of said hook passes and an indentation adapted to engage said notch in a locking relation.

2. The invention as recited in claim 1 wherein said plate has a first bent surface engaging portion and a second straight surface engaging portion, said portions being connected by a middle section arched in the direction of its length.

3. The invention as recited in claim 1, wherein said notch has one surface defined by the inside surface of said shank.

4. The invention as recited in claim 1, wherein said first board engaging portion has an upper part bent parallel to said shank and adapted to contact the inside surface of said board while said contacts the outside surface thereof.

* * * * *